US010378248B1

(12) United States Patent
Kelsch et al.

(10) Patent No.: US 10,378,248 B1
(45) Date of Patent: Aug. 13, 2019

(54) ANTI-THEFT DEVICE WITH ADJUSTABLE LOCKING ARMS FOR SECURING AN ARTICLE OF MERCHANDISE

(71) Applicants: Christopher A. Kelsch, Palm Harbor, FL (US); Vanguard Products Group, Inc., Oldsmar, FL (US)

(72) Inventors: Christopher A. Kelsch, Palm Harbor, FL (US); John N. Figh, Jr., Oldsmar, FL (US); Matthew Kuntz, Tampa, FL (US); Lucas P. Swartwood, San Jose, CA (US); Wade Zhu, Westchase, FL (US); Volodymyr Andreev, Lviv (UA); Peter D. Iezzi, Coral Springs, FL (US); Andriy Los, Lviv (UA)

(73) Assignee: Vanguard Products Group, Inc., Oldsmar, FL (US)

( * ) Notice: Subject to any disclaimer, the term of this patent is extended or adjusted under 35 U.S.C. 154(b) by 0 days.

(21) Appl. No.: 16/050,696

(22) Filed: Jul. 31, 2018

(51) Int. Cl.
*E05B 73/00* (2006.01)
*E05B 35/00* (2006.01)
*E05B 47/00* (2006.01)

(52) U.S. Cl.
CPC ..... *E05B 73/0017* (2013.01); *E05B 35/008* (2013.01); *E05B 73/0029* (2013.01); *E05B 73/0082* (2013.01); *E05B 2047/002* (2013.01)

(58) Field of Classification Search
CPC ..... E05B 2047/002; E05B 2047/0021; E05B 2047/0022; E05B 53/008; E05B 73/00; E05B 73/0017; E05B 73/0029; E05B 73/0082
See application file for complete search history.

(56) References Cited

U.S. PATENT DOCUMENTS 5,715,711 A * 2/1998 Jennison ..... B60R 25/093 188/32
6,237,375 B1 * 5/2001 Wymer ..... E05B 73/0082 248/551
8,464,563 B2 * 6/2013 Perez ..... E05B 73/0023 206/308.2
8,711,553 B2 * 4/2014 Trinh ..... A47F 7/0246 248/206.5
9,097,380 B2 * 8/2015 Wheeler ..... A47F 7/024
9,161,466 B2 * 10/2015 Huang ..... H05K 5/0204
(Continued)

*Primary Examiner* — Christopher J Boswell
(74) *Attorney, Agent, or Firm* — Andriy Lytvyn; Smith & Hopen, P.A.

(57) ABSTRACT

An anti-theft device for securing an article of merchandise against unauthorized removal from a display counter. The anti-theft device includes two pairs of arms slidingly disposed within the housing. Grips are disposed on distal ends of the arms and are configured to receive and secure edges of an article of merchandise. A locking mechanism is disposed within the housing of the anti-theft device. The locking mechanism includes two locking components in a sliding configuration with respect to one another. Complimentary gear teeth are disposed on the outer edges of the locking component and the inner edges of the arms. An actuator transitions the locking components between a first unlocked configuration in which the gear teeth of the locking components are retracted away from the gear teeth of the arms, and a second locked configuration in which the gear teeth of the locking components engage the gear teeth of the arms.

18 Claims, 7 Drawing Sheets

(56) References Cited

U.S. PATENT DOCUMENTS

| | | | | |
|---|---|---|---|---|
| 9,334,679 | B2 * | 5/2016 | Lin | F16M 13/02 |
| 9,797,543 | B2 * | 10/2017 | Lin | E05B 73/0082 |
| 10,001,153 | B1 * | 6/2018 | Fan | F16B 2/12 |
| 2010/0079285 | A1 * | 4/2010 | Fawcett | E05B 73/0005 340/568.1 |
| 2012/0312936 | A1 | 12/2012 | Huang | |
| 2015/0129724 | A1 | 5/2015 | Kohmoto et al. | |
| 2016/0201359 | A1 | 7/2016 | Berglund et al. | |
| 2017/0206757 | A1 | 7/2017 | Grant et al. | |

* cited by examiner

ANTI-THEFT DEVICE WITH ADJUSTABLE LOCKING ARMS FOR SECURING AN ARTICLE OF MERCHANDISE

BACKGROUND OF THE INVENTION

1. Field of the Invention

This invention relates to merchandise anti-theft devices. More specifically, it relates to an anti-theft device having adjustable arms and a locking mechanism for securing an article of merchandise against unauthorized removal from a display counter.

2. Brief Description of the Related Art

Retailers often prefer to present their merchandise to consumers in a way that allows the consumers to touch, inspect, and otherwise interact with the products at a display counter. Many merchandise items, especially portable electronic devices, are relatively expensive and, therefore, are under a serious threat of theft. Retailers often face a dilemma pertaining to how to interactively display their merchandise to attract customers and increase sales, while, at the same time, safeguarding the merchandise against theft.

Several anti-theft devices are currently known in the art, but they have serious flaws. One example of an existing anti-theft device is disclosed in a published PCT application WO 2011/032147. The device includes a housing that attaches to the back cover of the gadget via an adhesive layer. Two arms extend laterally from the housing and grasp the opposite edges of the gadget, thereby securing it within the clamp. This anti-theft device, however, has a serious flaw: many electronic gadgets have removable back covers, which makes them vulnerable to theft because thieves can easily circumvent this anti-theft device by simply removing the back cover of the gadget and sliding the gadget out of the grasping arms. This flaw significantly undermines the efficacy of this device rendering it inadequate for many electronic gadgets.

Other currently available anti-theft solutions involve obtrusive and aesthetically unattractive devices such as steel cables, locks, and casings. Although these security measures may effectively protect against theft, they have a negative effect on the consumers by discouraging interaction with products and may ruin overall ambience of a retail store. Accordingly, there exists an unresolved need for a discrete and effective anti-theft device that adequately secures an electronic gadget while allowing the prospective purchasers to fully experience the gadget without obstructing access to any of the gadget's functional features, including the front screen.

SUMMARY OF THE INVENTION

The invention pertains to an anti-theft security device that involves two sets of adjustable bracket arms having grips configured to receive opposite edges of an article of merchandise. The two sets of adjustable arms are in an orthogonal relationship with one another. Each arm is independently adjustable by sliding in and out relative to the housing of the anti-theft device. The four adjustable arms are spaced apart such that their inner edges define a rectangular aperture. Each inner edge has a plurality of gear teeth disposed therealong.

A locking mechanism is disposed within the housing and within the rectangular aperture defined by the inner edges of the bracket arms. The locking mechanism comprises two locking components in a sliding relationship with one another. A biasing member urges the two locking components toward one another such that their surfaces mate. The locking components have gear teeth configured to interlock with the gear teeth disposed on the inner edges of the arms. When the locking components are retracted from the arms, the gear teeth of the locking components disengage the gear teeth on the arms—this is the unlocked configuration. In the unlocked configuration, the bracket arms are free to slide with respect to the housing, thereby enabling the arms to adjust to accommodate the geometry of the article of merchandise, such that the grips secure the edges thereof.

The inner edges of the locking components have complementary notches, which form a funnel-like opening when the two locking components are in a mated configuration. An actuator having a pointed end is disposed over this funnel-like opening. The actuator is configured to translate along the center axis thereof in an inward direction relative to the housing. As the actuator translates inwardly, its pointed end engages the notches applying a force that opposes the biasing force retaining the locking components in a mated configuration. Thus, as the actuator is translated inwardly with respect to the housing, the locking components are displaced apart against the biasing force. When the locking components are displaced, the gear teeth of the locking components engage the gear teeth disposed on the inner edges of the adjustable arms, thereby immobilizing the arms with respect to the housing.

When the arms are immobilized, the anti-theft device is in its locked configuration. To transition the anti-theft device into the unlocked configuration, the actuator must be translated outwardly with respect to the housing. As the actuator disengages the notches of the locking components, the biasing force exerted onto the locking components by the biasing element urges the locking components toward one another and away from the arms, thereby disengaging the gear teeth of the locking components from the gear teeth of the arms. In this unlocked configuration, the arms can slide relative to the housing, thereby releasing the grips from edges of the article of merchandise.

DESCRIPTION OF THE DRAWINGS

For a fuller understanding of the invention, reference should be made to the following detailed description, taken in connection with the accompanying drawings, in which.

DETAILED DESCRIPTION OF THE PREFERRED EMBODIMENT

In the following detailed description of the preferred embodiment, reference is made to the accompanying drawings, which form a part hereof, and within which specific embodiments are shown by way of illustration by which the invention may be practiced. It is to be understood that other embodiments may be utilized and structural changes may be made without departing from the scope of the invention.

Figure 1A:
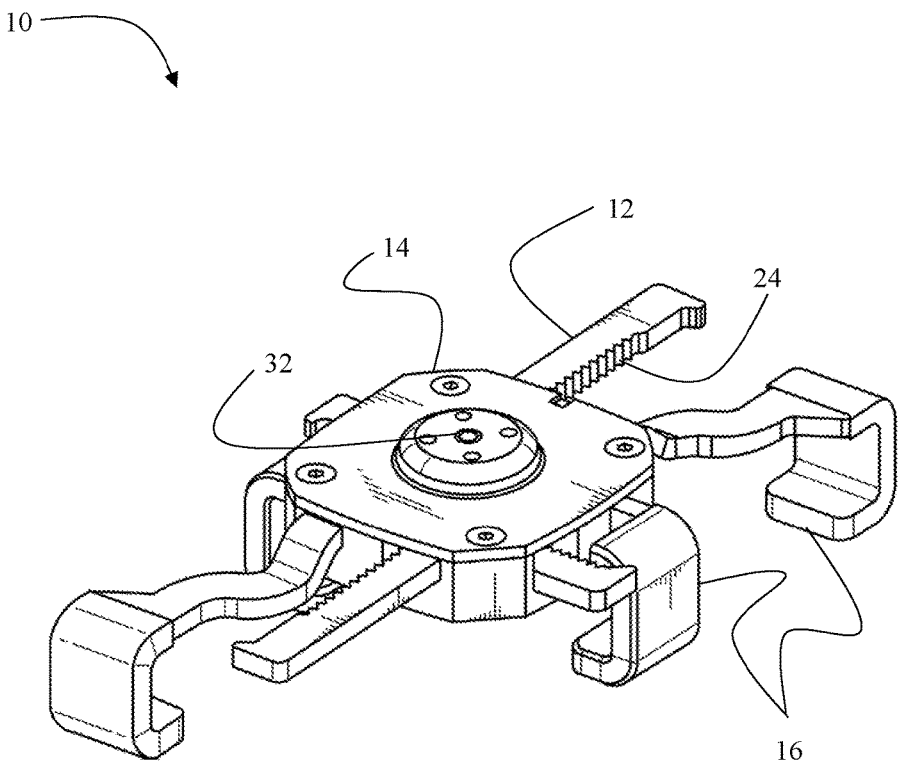
FIG. 1A is a perspective view of the anti-theft device.
Figure 1B:
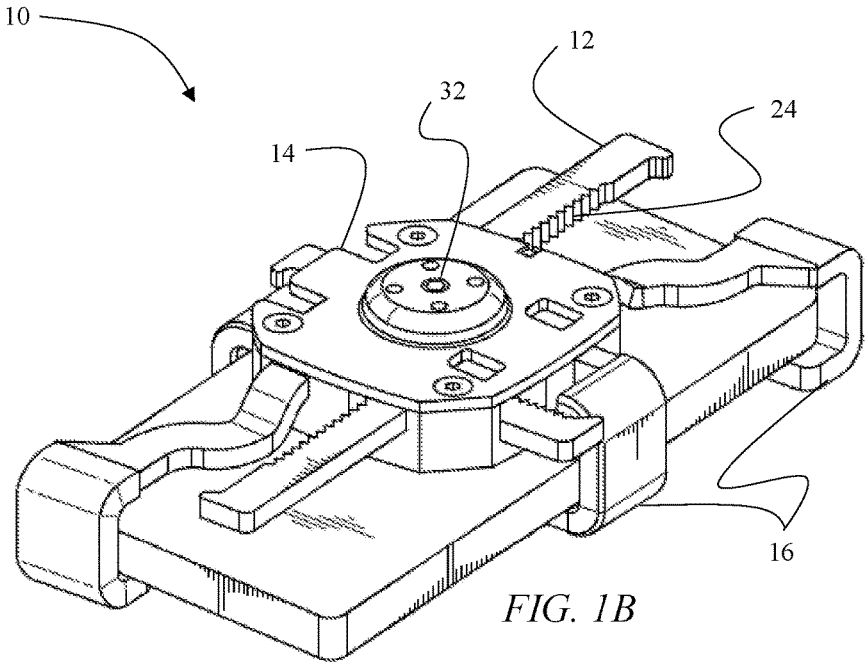
FIG. 1B is a perspective view of the anti-theft device securing an article of merchandise.

FIGS. 1A-B depict an anti-theft security device 10. Security device 10 has two sets of adjustable bracket arms 12 disposed within a housing 14. The distal end of each arm has a C-shaped grip 16 configured to receive an edge of an article of merchandise. The two sets of adjustable arms 12 are in an orthogonal relationship with one another. The length of each arm 12 is independently adjustable by sliding arm 12 relative to housing 14. This configuration enables arms 12 to adjust to the geometry of the article of merchandise.

Referring to FIGS. 1A-B, the following is a description of the method of securing the article of merchandise within security device 10 and, subsequently, releasing the article of merchandise therefrom. When unlocked, arms 12 are configured to slide in a direction away from housing 14, thereby increasing a distance between opposite grips 16. When the distance between opposite grips 16 exceeds the dimensions of the article of merchandise, the article of merchandise can be positioned between grips 16. At this point, arms 12 can be manipulated to slide toward one another, thereby decreasing the distance between opposite grips 16 until they engage the edges of the article of merchandise. In this configuration, the article of merchandise is secured to housing 14 by grips 16. To release the article of merchandise from housing 14, arms 12 are manipulated to slide outward from housing 14, thereby increasing the distances between opposite grips 16. Once the distance between opposite grips 16 exceeds the dimensions of the article of merchandise, the article of merchandise can be removed from security device 10.

Figure 2A:
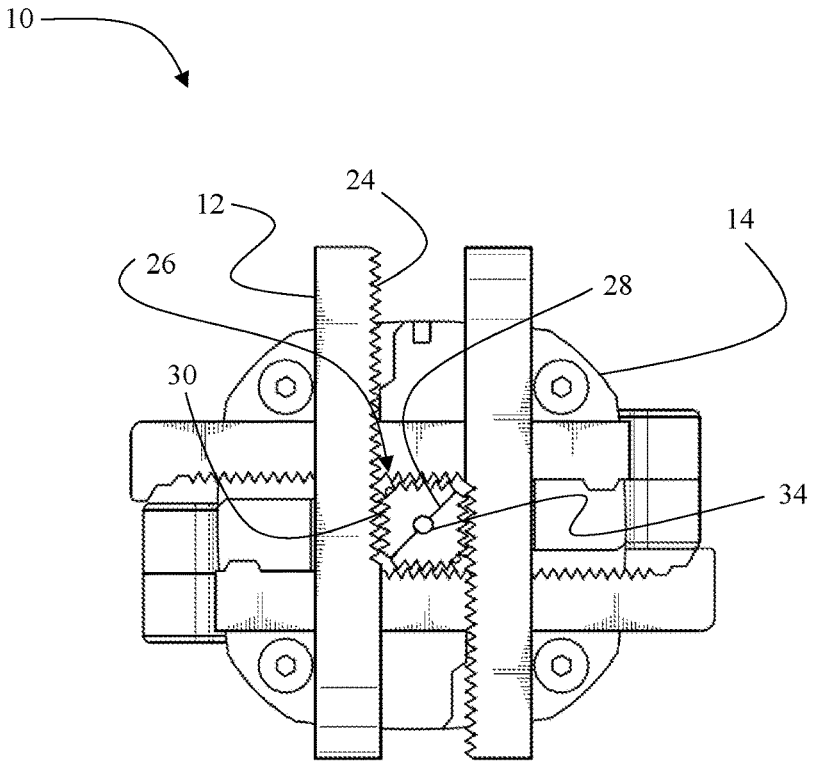
FIG. 2A is a top view of the anti-theft device in an unlocked configuration.
Figure 2B:
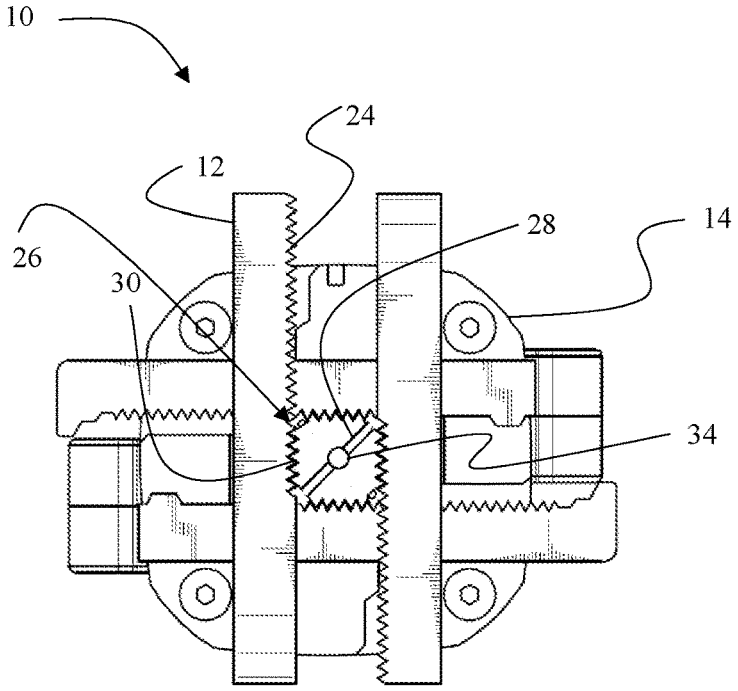
FIG. 2B is a top view of the anti-theft device in a locked configuration.

To ensure that arms 12 cannot be manipulated by an unauthorized individual, security device 10 includes a locking mechanism 20, depicted in FIGS. 2A and 2B. Arms 12 are disposed within housing 14 in an orthogonal relationship with one another, such that each longitudinal arm 12 overlaps two latitudinal arms 12. This configuration results in a rectangle being formed between overlapping arms 12, wherein the rectangle is defined by inner edges of arms 12. Each inner edge has a rack of gear teeth 24 disposed therealong.

As depicted in FIGS. 2A and 2B, locking mechanism 20 is disposed within housing 14 inside the rectangle formed by overlapping bracket arms 12. Locking mechanism 26 comprises two locking components 28. Each locking component 28 has a right-triangular shape with a plurality of gear teeth 30 disposed along the legs of the right triangle. Gear teeth 30 are configured to interlock with gear teeth 24.

Locking components 28 are configured to transition between an unlocked configuration depicted in FIG. 2A into a locked configuration depicted in FIG. 2B. In the unlocked configuration, hypotenuse sides of two locking components 28 are in a close proximity or in an abutting relation with respect to one another. In this configuration, gear teeth 30 are disengaged from gear teeth 24, and, therefore, arms 12 are free to slide outwardly with respect to housing 14.

In the locked configuration, depicted in FIG. 2B, locking components 28 are moved away from one another. In this configuration gear teeth 30 of locking components 28 engage gear teeth 24 of arms 12. Because arms 12 in in an orthogonal orientation with respect to one another, and because gear teeth 30 are disposed in a right-angle arrangement along the edges of the locking components 26, each locking component 28 is configured to simultaneously engage two arms 12. Thus, in the locked configuration, gear teeth 30 of two locking components 28 engage gear teeth 24 of all four arms 12. In this configuration, arms 12 are immobilized because interlocking of gear teeth 30 and gear teeth 24 restricts arms 12 against movement relative to housing 14. Therefore, when the article of merchandise is secured within grips 16, and security device 10 is in its locked configuration, the article of merchandise cannot be removed from grips 16 until locking components 28 are retracted, thereby releasing arms 12.

FIGS. 3A-C and 4A-B illustrate the mechanism and method of transitioning locking mechanism 24 between the locked and unlocked configurations. Housing 14 includes a port 32 disposed directly above the line at which hypotenuse edges of locking components 28 meet. An actuator 34 is disposed within the port 32. Actuator 34 is configured to translate along a vertical center axis of port 32, whereby actuator 34 can move in a downward direction toward locking components 28, and in an upward direction away from locking components 28. In an embodiment, port 32 and actuator 34 have complimentary threads, whereby actuator 34 can be translated along the center axis of port 32 by clockwise or counterclockwise rotation. In other embodiments, various means known in the art for achieving a connection between a female port and a male component, whereby the male component is movable along the center axis of the female port can be implemented.

Figure 3A:
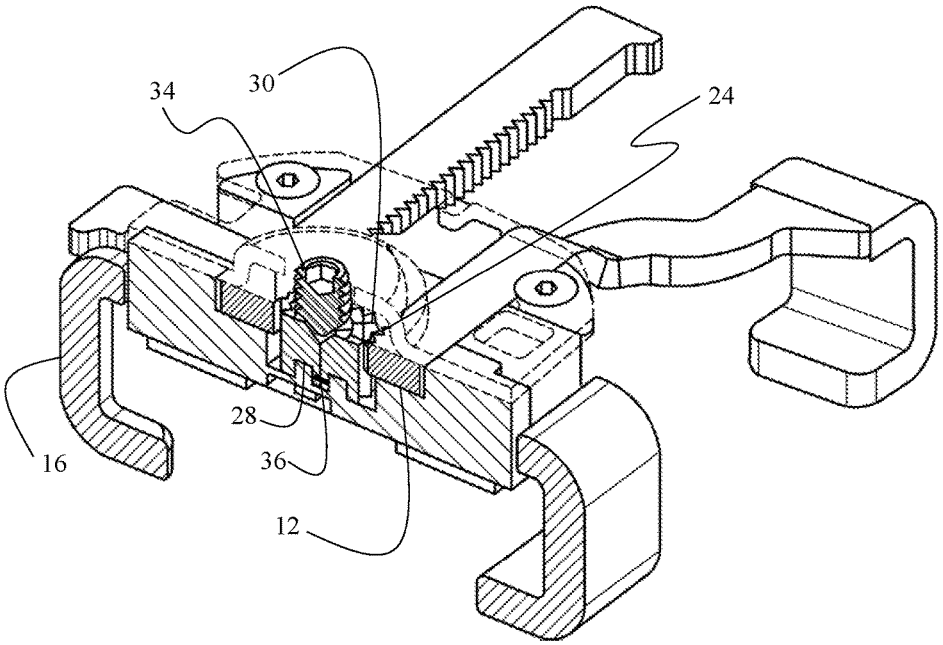
FIG. 3A is a perspective cut-away view of the anti-theft device in an unlocked configuration.
Figure 3B:
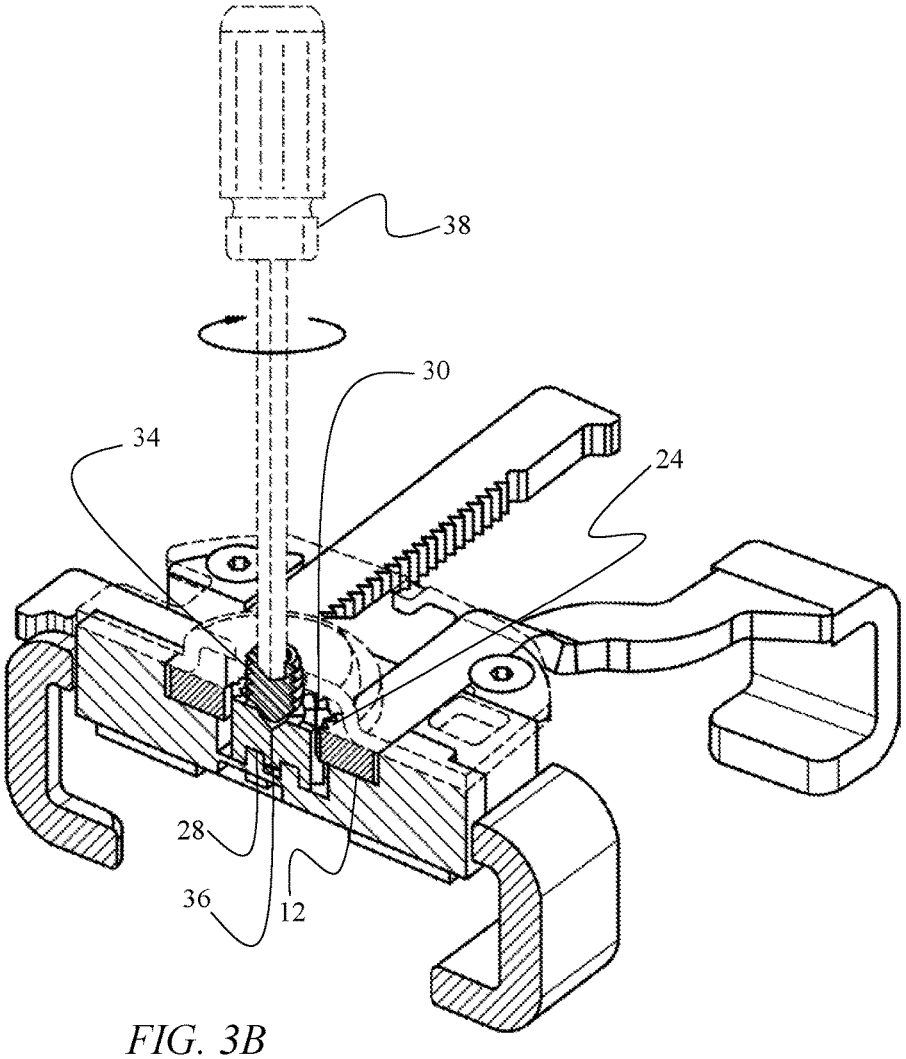
FIG. 3B is a perspective cut-away view of the anti-theft device in an unlocked configuration, wherein a semi-specialized tool is being used to operate the actuator.
Figure 3C:
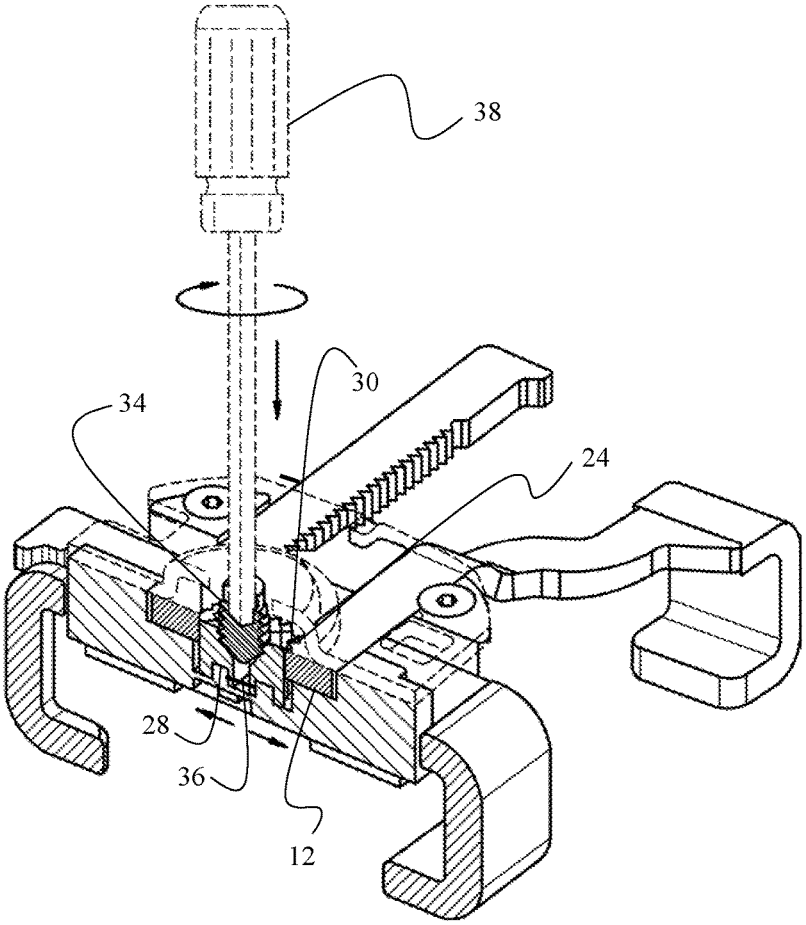
FIG. 3C is a perspective cut-away view of the anti-theft device in a locked configuration, after the semi-specialized tool has been used to move the actuator.
Figure 4A:
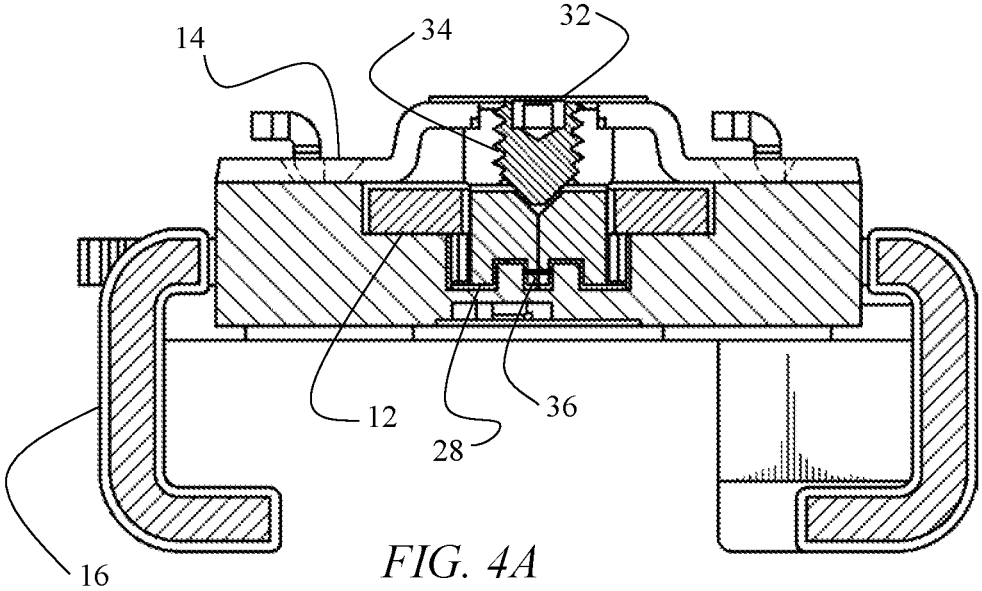
FIG. 4A is a front cut-away view of the anti-theft device in an unlocked configuration.

FIGS. 3A-C and 4A-B depict locking components 28 having sloping inner edges. Actuator 34 has a pointed distal end configured to engage the sloping edges of locking components 28. Locking components 28 are biased toward one another by a biasing element 36. Thus, as depicted in FIGS. 3A-B and 4A, when actuator 34 is in its retracted configuration, locking components 28 are biased toward one another. In this configuration, gear teeth 30 are retracted away from gear teeth 24, and, therefore, arms 12 are free to slide with respect to housing 14.

Figure 4B:
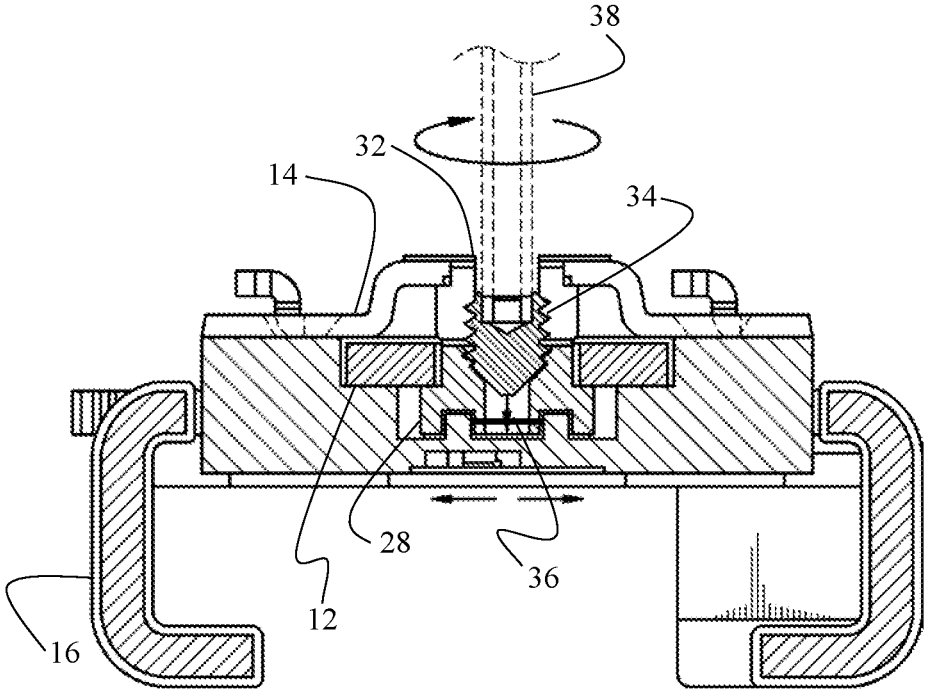
FIG. 4B is a front cut-away view of the anti-theft device in a locked configuration.

FIGS. 3B-C and 4B depict a semi-specialized tool 38 being used to manipulate actuator 34 in the embodiment in which port 32 and actuator 34 are in a screw-threaded engagement with one another. Clockwise rotation of tool 38 drives actuator downward.

The pointed distal end of actuator 34 applies a force onto the sloping edges of locking members 28. Because the edges of locking members 28 and the pointed distal end of actuator 34 have complementary slopes, the force applied onto locking members 28 by actuator 34 has a horizontal component. The horizontal component of the applied force exceeds the biasing force exerted by biasing element 36, thereby causing locking members 28 to slide apart toward position depicted in FIGS. 3C and 4B. In this configuration, gear teeth 30 of locking components 28 engage gear teeth 30 disposed along inner edges of arms 12, thereby immobilizing arms 12 within housing 14. This is the locked configuration of security device 10.

To transition security device 10 into the unlocked configuration, an authorized personnel member in possession of tool 38 uses tool 38 to rotate actuator 34 in a counterclockwise direction, thereby retracting actuator away from locking components 28. Biasing element 36 pulls locking components 28 toward each other, thereby disengaging gear teeth 30 from gear teeth 24. When the gear teeth 30 fully disengage gear teeth 24, security device 10 is in the unlocked configuration and lengths of arms 12 can be adjusted, thereby releasing the article of merchandise from grips 16.

The advantages set forth above, and those made apparent from the foregoing description, are efficiently attained. Since certain changes may be made in the above construction without departing from the scope of the invention, it is intended that all matters contained in the foregoing description or shown in the accompanying drawings shall be interpreted as illustrative and not in a limiting sense.

What is claimed is:

1. An anti-theft device for securing an article of merchandise, comprising:

a housing;

a first pair of arms and a second pair of arms slidingly disposed within the housing, the first pair of arms being in an orthogonal orientation relative to the second pair of arms, wherein a length of each arm extending beyond the housing is independently adjustable by sliding the arm inwardly or outwardly with respect to the housing;

a grip disposed at an end of each arm, each grip configured to receive an edge of the article of merchandise;

a first set of gear teeth disposed along each arm;

at least two locking components slidingly disposed within the housing;

a second set of gear teeth disposed on each of the locking components, the second set of gear teeth disposed on the locking components configured to interlock with the first set of gear teeth disposed along the arms, whereby the anti-theft device has a first unlocked configuration in which the locking components are radially retracted away from the arms such that the first and the second sets of gear teeth are disengaged, and a second locked configuration in which the first and the second sets of gear teeth are interlocked; and an actuator disposed within the housing, the actuator configured to apply a force onto the first and the second locking components to transition them from the first unlocked configuration into the second locked configuration, thereby immobilizing the arms within the housing.

2. The anti-theft security device of claim 1, further comprising a biasing element configured to retract the locking components away from the first and the second pairs of arms, thereby urging the locking components toward the first unlocked configuration.

3. The anti-theft security device of claim 2, wherein the force applied onto the locking components by the actuator exceeds the biasing force exerted by the biasing element.

4. The anti-theft security device of claim 1, wherein the actuator is screw-threadedly disposed within the housing, whereby rotation of the actuator about a longitudinal center axis thereof causes the actuator to apply the force onto the locking components.

5. The anti-theft security device of claim 1, wherein a semi-specialized tool is required to displace the actuator within the housing, whereby displacement of the actuator causes the actuator to apply the force onto the first and second locking components.

6. The anti-theft security device of claim 1, wherein the first locking component is configured to engage at least one arm from each of the first pair and the second pair of arms.

7. The anti-theft security device of claim 1, wherein the first and the second locking components have right triangular shapes, and wherein the second set of gear teeth is disposed along legs of the right triangular shapes.

8. The anti-theft security device of claim 1, wherein the first and the second locking components have at least partially sloped edges and the actuator has a pointed distal end engaging each of the sloped edges, whereby linear translation of the actuator along a longitudinal center axis thereof applies the force onto the first and the second locking components, wherein the force has a component perpendicular to the longitudinal center axis of the actuator, whereby the linear translation of the actuator causes the first and the second locking components to slide apart from one another and toward the arms.

9. The anti-theft security device of claim 1, wherein the housing has a female port in which the actuator resides, the female port having an opening on a first surface of the housing opposite to a second surface of the housing facing the article of merchandise, thereby enabling access to the actuator when the article of merchandise is secured within the anti-theft device.

10. A method of securing an article of merchandise within an anti-theft device, comprising:

receiving the anti-theft device having a housing and four arms slidingly disposed therein, each arm having a grip disposed on an end thereof;

extending four arms of the anti-theft security by sliding each arm out of a housing;

positioning an article of merchandise between the grips;

retracting the arms into the housing such that each grip receives an edge of the article of merchandise;

operating an actuator disposed within the housing to transition the anti-theft device from a first unlocked configuration into a second locked configuration, wherein operation of the actuator causes the actuator to apply a force onto locking components residing within the housing, thereby causing the locking components to radially translate within the housing toward the arms until the locking components engages the arms, wherein in the first unlocked configuration the locking components are retracted away from the arms;

wherein a first set of gear teeth is disposed along the arms and a second set of gear teeth is disposed on the locking components, whereby, in the second locked configuration, the second set of gear teeth disposed on the locking components interlocks the first set of gear teeth disposed along the arms, thereby immobilizing the arms within the housing and retaining the article of merchandise within the grips.

11. The method of claim 10, wherein a biasing element is disposed within the housing and is configured to retract the first and the second locking components away from the arms, thereby urging the anti-theft device into the first unlocked configuration.

12. The method of claim 11, wherein the force applied onto the locking components by the actuator exceeds the biasing force exerted by the biasing element.

13. The method of claim 10, wherein the actuator is screw-threadedly disposed within the housing, whereby operation of the actuator involves rotation of the actuator about its longitudinal center axis.

14. The method of claim 10, wherein a semi-specialized tool is required to operate the actuator.

15. The method of claim 10, wherein each of the locking components is configured to immobilize two arms, wherein the two arms being immobilized are in an orthogonal orientation with one another.

16. The method of claim 10, wherein the locking components have right triangular shapes, and wherein the second set of gear teeth is disposed along legs of the right triangular shapes.

17. The method of claim 10, wherein the locking components have at least partially sloped edges and the actuator has a pointed distal end engaging each of the sloped edges.

18. The method of claim 10, wherein the housing has a female port in which the actuator resides, the female port having an opening on a first surface of the housing opposite to a second surface of the housing facing the article of merchandise, thereby enabling access to the actuator when the article of merchandise is secured within the anti-theft device.

* * * * *